US008430157B1

(12) United States Patent
Votaw

(10) Patent No.: US 8,430,157 B1
(45) Date of Patent: Apr. 30, 2013

(54) THERMAL CONTROL SYSTEM

(76) Inventor: James C. Votaw, Perry, OK (US)

( * ) Notice: Subject to any disclaimer, the term of this patent is extended or adjusted under 35 U.S.C. 154(b) by 379 days.

(21) Appl. No.: 12/714,211

(22) Filed: Feb. 26, 2010

Related U.S. Application Data

(60) Provisional application No. 61/156,392, filed on Feb. 27, 2009.

(51) Int. Cl.
*E21B 36/00* (2006.01)
*E21B 43/24* (2006.01)

(52) U.S. Cl.
USPC ..... 166/57; 166/61; 166/302

(58) Field of Classification Search ..... 166/57, 166/302
See application file for complete search history.

(56) References Cited

U.S. PATENT DOCUMENTS

| | | | | |
|---|---|---|---|---|
| 2,911,047 | A | 11/1959 | Henderson | |
| 3,062,289 | A | 11/1962 | Eades | |
| 3,749,163 | A | 7/1973 | Waters | |
| 4,060,997 | A * | 12/1977 | Shultz et al. | 62/180 |
| 4,577,693 | A * | 3/1986 | Graser | 166/338 |
| 4,641,710 | A | 2/1987 | Klinger | |
| 5,049,724 | A | 9/1991 | Anderson | |
| 5,055,185 | A * | 10/1991 | McMurphy | 210/123 |
| 5,098,036 | A * | 3/1992 | Brigham et al. | 244/134 R |
| 6,009,940 | A | 1/2000 | Eck et al. | |
| 6,032,732 | A | 3/2000 | Yewell | |
| 6,260,615 | B1 | 7/2001 | Dalrymple et al. | |
| 6,588,500 | B2 | 7/2003 | Lewis | |
| 6,776,227 | B2 | 8/2004 | Beida et al. | |
| 7,017,542 | B2 * | 3/2006 | Wilton et al. | 123/179.3 |
| 7,037,105 | B2 * | 5/2006 | Hayes | 432/63 |
| 7,122,979 | B2 * | 10/2006 | Wilton et al. | 318/400.09 |
| 7,138,093 | B2 * | 11/2006 | McKay et al. | 422/198 |
| 7,293,606 | B2 * | 11/2007 | Benoit et al. | 166/57 |
| 7,424,916 | B2 * | 9/2008 | Foster et al. | 166/303 |
| 7,614,367 | B1 * | 11/2009 | Frick | 122/26 |
| 7,987,844 | B2 * | 8/2011 | Zillmer et al. | 126/611 |
| 2004/0026142 | A1 * | 2/2004 | Schmitz et al. | 180/65.3 |
| 2005/0224223 | A1 * | 10/2005 | Hayes | 166/57 |
| 2007/0181356 | A1 * | 8/2007 | Ando et al. | 180/65.4 |
| 2007/0261823 | A1 * | 11/2007 | Masters et al. | 165/110 |
| 2008/0271882 | A1 * | 11/2008 | Irwin | 166/57 |
| 2009/0114211 | A1 * | 5/2009 | Homyk et al. | 126/578 |
| 2009/0217907 | A1 * | 9/2009 | Garman et al. | 123/362 |
| 2010/0019896 | A1 * | 1/2010 | Flick | 340/539.11 |
| 2010/0192875 | A1 * | 8/2010 | Frick | 122/26 |

* cited by examiner

*Primary Examiner* — Daniel P Stephenson
*Assistant Examiner* — Michael Wills, III
(74) *Attorney, Agent, or Firm* — Hall Estill Attorneys at Law; Daniel P. Dooley

(57) ABSTRACT

A thermal control system and method of using same are disclosed. Preferably, the thermal control system includes at least a combination data logger and control module interacting with a heat transfer medium circulation device, a heat transfer medium distribution system communicating with a heat transfer medium circulation device, and a service object interacting with a heat transfer distribution system, wherein the heat transfer medium distribution system facilitates heat transfer between the service object and a heat transfer medium confined within the heat transfer medium distribution system. Preferably, the thermal control system further includes a pair of motors each configured for driving the heat transfer medium circulation device, and a motor control and switching circuit responsive to a predetermined signal provided by the data logger and control module for selecting one of the pair of motors for use in driving the heat transfer medium circulation device.

20 Claims, 2 Drawing Sheets

THERMAL CONTROL SYSTEM

RELATED APPLICATIONS

This application claims priority to U.S. Provisional Application No. 61/156,392 filed Feb. 27, 2009, entitled "Thermal Control System."

FIELD OF THE INVENTION

This invention relates to new and useful improvements in thermal control systems. In particular, but not by way of limitation, to thermal control systems, which generates, controls, and utilizes its own source of energy for maintaining a desired temperature of a service item, such as an oil or gas well head, an output line associated with the well head, or a combination of both.

BACKGROUND

Freezing of wellhead equipment is a common risk for oil wells and gas wells in regions that experience extremely cold winters, such as Alaska, Colorado and northern Canada. Natural gas contains hydrates, which may condense out of the gas and then solidify when temperatures are very low, particularly when the situation is aggravated by a drop in gas pressure. Unless sufficient heat is provided, or unless other means are provided for preventing condensation of hydrates, the wellhead equipment installed on a producing well to control and regulate flow of oil or gas, as the case may be, can "freeze off" and cease to function when temperatures fall below freezing (i.e., zero degrees Celsius). When this happens, valuable production is lost, and additional expense must be incurred to have skilled technicians attend at the well site to remedy the freeze-off and restore flow from the well.

U.S. Pat. No. 6,032,732, issued to Yewell on Mar. 7, 2000, discloses a wellhead heating system that circulates heated coolant, from a liquid-cooled engine driving an oil well pumper, through insulated conduit arranged as desired in thermal contact with the wellhead equipment, such that heat from the circulating coolant is transferred to the equipment. The Yewell apparatus has a serious drawback, however, in that it is applicable only at well sites where a source of heated fluid is readily available, such as where a liquid-cooled engine has been provided for one reason or another.

Other approaches to the problem have included provision of heat tracing loops circulating hot water or steam from heaters or boilers, or direct injection of antifreeze fluids such as methanol. Once again, such approaches are excessively expensive if not entirely impractical for remote well sites, because of the cost and inconvenience of maintaining a reliable source of power or fuel for the heaters or boilers, or providing injection pumps and sufficient supplies of antifreeze fluids. In fact, well-operating companies may find it less costly overall to incur occasional production losses from wellhead freeze-off at remote well locations, plus the expense of sending technicians out to remedy freeze-off situations, than to provide means for keeping the remote wellheads warm, given the cost of providing heat sources (e.g., electric power, diesel generators, or propane heaters) or antifreeze injection equipment needed to prevent freeze-off.

For the foregoing reasons, there is a need in the oil and gas industry for improved apparatus and methods for preventing freezing of wellhead equipment associated with gas wells and oil wells. In particular, there is a need for such apparatus and methods that minimize or eliminate the need for antifreeze injection, or for supplementary power or fuel.

SUMMARY OF THE INVENTION

In accordance with preferred embodiments, a thermal control system and method of using same are provided. Preferably, the thermal control system includes at least a combination data logger and control module interacting with a heat transfer medium circulation device, a heat transfer medium distribution system communicating with a heat transfer medium circulation device, and a service object interacting with a heat transfer distribution system, wherein the heat transfer medium distribution system facilitates heat transfer between the service object and a heat transfer medium confined within the heat transfer medium distribution system. Preferably, the thermal control system further includes a pair of motors each configured for driving the heat transfer medium circulation device, and a motor control and switching circuit responsive to a predetermined signal provided by the data logger and control module for selecting one of the pair of motors for use in driving the heat transfer medium circulation device.

In an alternate preferred embodiment, the thermal control system is used by steps that include at least sensing a condition of a service object, determining a condition of a heat transfer medium, and activating a heat transfer medium circulation device when the sensed condition of the service object attains a predetermined condition. Preferably, the method of using the thermal control system further includes the steps of engaging a heat exchanger when the condition of the heat transfer medium attains a predetermined condition, disengaging an electric motor driving the heat transfer medium circulation device when a power source for the electric motor drops below a predetermined voltage level, and using a non-electric motor to drive the heat transfer medium circulation device when the electric motor driving a heat transfer medium circulation device is disengaged.

These and various other features and advantages that characterize the claimed invention will be apparent upon reading the following detailed description and upon review of the associated drawings.

DESCRIPTION OF THE PREFERRED EMBODIMENTS

Figure 1:
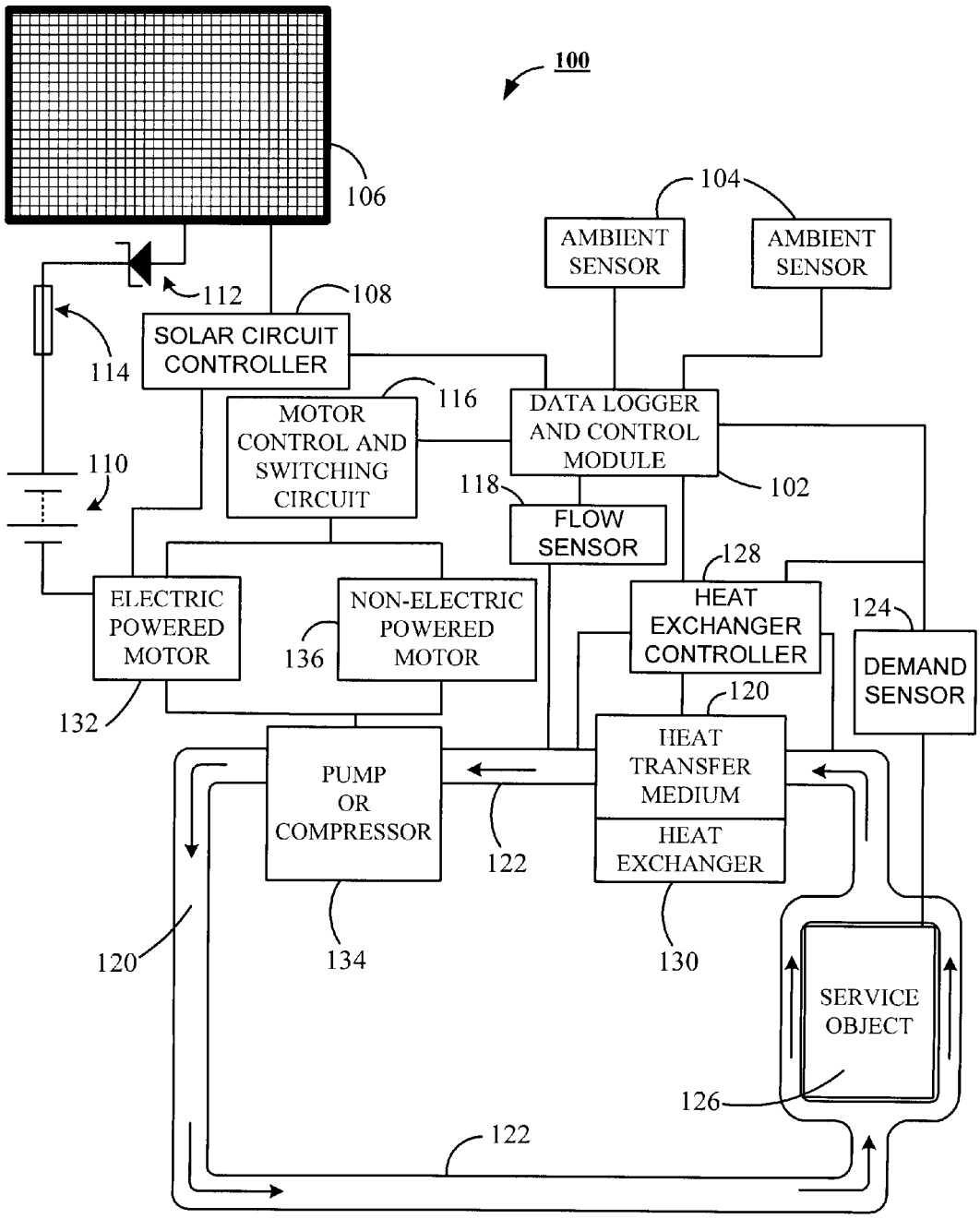
FIG. 1 shows a schematic diagram of a preferred embodiment of the inventive thermal control system of the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method or process is simply for identification and is not meant to indicate that the steps should be performed in a particular order. Other modifications and variations to the described embodiments are also contemplated within the scope and spirit of the invention.

Referring to the drawings, FIG. 1 shows a preferred embodiment of an inventive thermal control system 100 that includes a data logger and control module 102 (also referred to herein as "controller 102") programmed with a code for tracking the operational events of the thermal control system 100, and providing overall control of the thermal control system 100. In a preferred environment, the data logger and control module 102 communicates with a plurality of ambient sensors 104, which are used to collect the environmental conditions in which the thermal control system 100 is operating. The environmental conditions collected by the ambient sensors 104 include temperature readings, wind speed, the amount of ambient light present, and the angle of attack of the source of the ambient light.

Preferably the inventive thermal control system 100 further includes a solar panel 106, and a solar circuit controller 108. The solar circuit controller 108 is responsive to information provided by the data logger and control module 102 by aligning the solar panel 106 with the angle of attack of the source of the ambient light coming and further provides control over a charging circuit interacting with the solar panel 106 to charge a battery 110 of the thermal control system 100. In a preferred embodiment the charging circuit includes at least a diode 112 in series with a fuse 114 and the battery 110. The battery 110 preferably provides power to all of the electronic components and assemblies of the thermal control system 100, the preferred embodiment includes: the data logger and control module 102, the plurality of ambient sensors 104, the solar circuit controller 108, a motor control and switching circuit 116, a flow sensor 118, which monitors flow of a heat transfer medium 120 as the heat transfer medium flows through a heat transfer distribution system 122.

The battery 110 preferably further provides power to a demand sensor 124, which is operatively connected to a service object 126 for collecting a condition of the service object 126 and providing that information to a heat exchanger controller 128 and the data logger and control module 102. The heat exchanger controller 128 service to control the operation of a heat exchanger 130, used to modulate the thermal condition of the heat transfer medium 120. In a preferred embodiment, the battery 110 further provides power to an electric powered motor 132 that is configured for operating a heat transfer medium circulation device 134, which can be a pump when the heat transfer medium 120 is a coolant, or a compressor when the heat transfer medium 120 is a refrigerant.

An additional feature of the preferred embodiment of the inventive thermal control system 100 is the inclusion of the non-electric powered motor 136. A non-electric powered motor 136 is also configured for operation with the heat transfer medium circulation device 134. During the operation of the inventive thermal control system 100, the primary drive force for the heat transfer medium circulation device 134 is the electric powered motor 132. However, when the voltage of the battery 110 drops below a predetermined voltage level of substantially 11 volts, the motor control and switching circuit disengages the electric powered motor 132 from providing the driving force for the heat transfer medium circulation device 134, and engages the non-electric powered motor for use in providing the drive force for the heat transfer medium circulation device 134. Preferably, the electronic circuits provided by and included in the thermal control system 100 operating at a nominal operating voltage of five (5) volts, therefore the electronics associated with the thermal control system 100 will continue to operate even when the voltage of the battery 110 drops below the 11 volts threshold.

Figure 2:
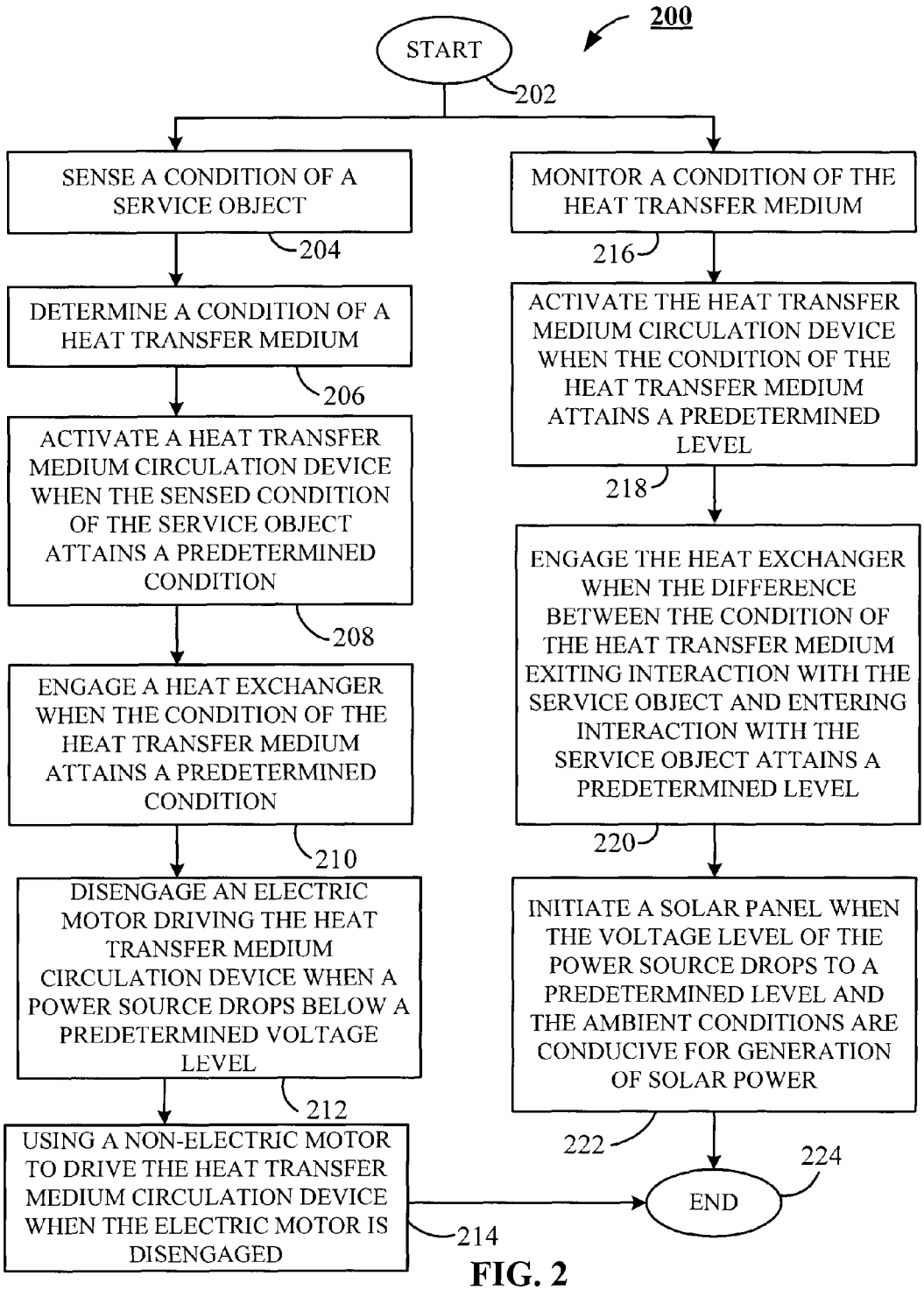
FIG. 2 shows a flow chart of a method of using the present inventive thermal control system of FIG. 1.

Turning to FIG. 2, shown therein is a flow chart 200, which depicts a method of operating a thermal control system (such as 100). The method commences at start process step 202 and proceeds to process step 204 with a sensing of a condition of a service object (such as 126), wherein in a preferred embodiment the condition sensed is the temperature of the service object, and the service object is a wellhead, or production line leading from the wellhead, or both. At process step 206, the method continues with the determining of a condition of a heat transfer medium (such as 120), which in the case of a coolant is the temperature of a coolant, and in the case of the refrigerant it is the pressure of the refrigerant present in the system.

At process step 208, a heat transfer medium circulation device (such as 134) is activated when the sensed condition of the service object obtains a predetermined condition, and at process step 210 a heat exchanger is engaged when the condition of a heat transfer medium obtains a predetermined condition. Continuing with process step 212, an electric motor (such as 132) driving the heat transfer medium circulation device is disengaged when a power source (such as battery 110) providing energy to the electric motor drops below a predetermined voltage level.

At process step 214, a non-electric motor (such as 136) is engaged in use to drive the heat transfer medium circulation device in response to the disengagement of the electric motor. To facilitate this function each of the motors communicates with the drive shaft of the heat transfer medium circulation device through corresponding clutches that are responsive to solenoids, which assure the clutches are inactive when the solenoids are in a normally opened state, and the process concludes at end process step 224.

In concert with process steps 204 through 214, the method of operating a thermal control system shown by flow chart 200 further includes process step 216, which includes monitoring the condition of the heat transfer medium. At process step 218, the heat transfer medium circulation device is activated when the condition of the heat transfer medium obtains a predetermined level, and at process step 220, the heat exchanger is engaged when the difference between the condition of the heat transfer medium exiting interaction with the service object and entering interaction with the service object obtains a predetermined differential level. At process step 222, a solar panel (such as 106) is initiated when the voltage level of power source drops to a predetermined level and the ambient conditions available to the thermal control system are conducive for generation of solar power, and the process concludes at end process step 224.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims.

What is claimed is:

1. A device comprising:

a combination data logger and control module;

a heat transfer medium circulation device responsive to the combination data logger and control module;

a heat transfer medium distribution system communicating with the heat transfer medium circulation device;

a service object interacting with the heat transfer medium distribution system, wherein the heat transfer medium distribution system facilitates heat transfer between the service object and a heat transfer medium confined within the heat transfer medium distribution system;

a pair of motors, each of the pair of motors coupled to the heat transfer medium circulation device, wherein one of the pair of motors is an electric motor, and the other motor of the pair of motors is a non-electric motor; and a motor control and switching circuit disposed between the data logger and control module and the pair of motors, the motor control and switching circuit selecting one of the pair of motors for use in driving the heat transfer medium circulation device in response to a predetermined signal provided by the data logger and control module.

2. The device of claim 1, further comprising a battery functionally coupled to the electric motor.

3. The device of claim 2, further comprising a solar panel communicating with the battery for use in charging the battery.

4. The device of claim 3, further comprising a solar circuit controller disposed between the combination data logger and control module and the solar panel, the solar circuit controller controlling the operation of a charging circuit disposed between the solar panel in the battery.

5. The device of claim 4, in which the solar circuit controller further aligns the solar panel in response to information provided by the combination data logger and control module.

6. The device of claim 1, in which the heat transfer medium circulation device is a pump when the heat transfer medium is a coolant.

7. The device of claim 6, further comprising a heat exchanger, the heat exchanger modulating the thermal condition of the coolant in response to a heat exchanger controller interacting with the heat exchanger.

8. The device of claim 7, further comprising a demand sensor communicating with the service object and, as well as the heat exchanger controller, the demand sensor collecting a condition status of the service object and providing said condition status to the heat exchanger controller, wherein the heat exchanger controller selectively controls the operation of the heat exchanger based on said condition status of the service object.

9. The device of claim 8, further comprising a flow sensor communicating with the coolant, as well as the combination data logger and control module, wherein the flow sensor monitors flow of the coolant and provides a flow status of the coolant to the combination data logger and control module as input for controlling the motor control and switching circuit.

10. The device of claim 6, further comprising a heat exchanger interacting with the coolant, and a heat exchanger controller communicating with the coolant prior to the coolant interacting with the service object and after interaction of the coolant with the service object, wherein when a difference between a condition of the coolant exiting interaction with the service object and entering interaction with the service object obtains a predetermined differential level, the heat exchanger controller selectively controls the operation of the heat exchanger based on said predetermined differential level.

11. The device of claim 1, in which the heat transfer medium circulation device is a compressor when the heat transfer medium is a refrigerant.

12. The device of claim 11, further comprising a heat exchanger, the heat exchanger modulating the thermal condition of the refrigerant in response to a heat exchanger controller interacting with the heat exchanger.

13. The device of claim 12, further comprising a demand sensor communicating with the service object, as well as the heat exchanger controller, the demand sensor collecting a condition status of the service object and providing said condition status to the heat exchanger controller, wherein the heat exchanger controller selectively controls the operation of the heat exchanger based on said condition status of the service object.

14. The device of claim 13, further comprising a flow sensor communicating with each the refrigerant and the combination data logger and control module, wherein the flow sensor monitors flow of the refrigerant and provides a flow status of the refrigerant to the combination data logger and control module as input for controlling the motor control and switching circuit.

15. The device of claim 11, further comprising a heat exchanger interacting with the refrigerant, and a heat exchanger controller communicating with the refrigerant prior to the refrigerant interacting with the service object and after interaction of the refrigerant with the service object, wherein when a difference between a condition of the refrigerant exiting interaction with the service object and entering interaction with the service object obtains a predetermined differential level, the heat exchanger controller selectively controls the operation of the heat exchanger based on said predetermined differential level.

16. A method by steps comprising:

sensing a condition of a service object;

determining a condition of a heat transfer medium;

activating a heat transfer medium circulation device when the sensed condition of the service object attains a predetermined condition, the heat transfer medium circulation device coupled to a pair of motors, wherein one of the pair of motors is an electric motor, and the other motor of the pair of motors is a non-electric motor; and engaging a heat exchanger when the condition of the heat transfer medium attains a previously determined condition;

disengaging an electric motor driving the heat transfer medium circulation device when a power source for the electric motor drops below a prearranged voltage level; and using a non-electric motor to drive the heat transfer medium circulation device when the electric motor driving a heat transfer medium circulation device is disengaged.

17. The method of claim 16, in which the heat transfer medium circulation device is a pump.

18. The method of claim 16, in which the heat transfer medium circulation device is a compressor.

19. The method of claim 16, by steps further comprising:

sensing an ambient condition external to the service object; and comparing the sensed condition of the service object to the sensed ambient condition and to the sensed condition of the heat transfer medium to determine a desired state of the heat exchanger.

20. The method of claim 19, by steps further comprising:

monitoring a condition of the heat transfer medium;

activating a heat transfer medium circulation device when the condition of the heat transfer medium attains the previously determined condition;

engaging the heat exchanger when the difference between the condition of the heat transfer medium exiting interaction with the service object and entering interaction with the service object attains a previously determined level; and initiating a solar panel when the voltage level of a power source drops to a predetermined level and the ambient conditions are conducive for generation of solar power.

* * * * *